United States Patent [19]

Kokeisl

[11] 4,047,726

[45] Sept. 13, 1977

[54] DEVICE FOR BUNDLING SKIS TOGETHER IN PAIRS

[76] Inventor: Walter Kokeisl, Zurlindenstrasse 21, 5000 Aarau, Switzerland

[21] Appl. No.: 661,519

[22] Filed: Feb. 26, 1976

[30] Foreign Application Priority Data

Feb. 27, 1975 Switzerland ..... 2467/75

[51] Int. Cl.[2] ..... A63C 11/02

[52] U.S. Cl. ..... 280/11.37 A; 24/73 SG; 280/11.37 E

[58] Field of Search ..... 280/11.37 A, 11.37 E; 24/73 SG, 81 SK; 224/45 S, 5 Z; 70/58

[56] References Cited

U.S. PATENT DOCUMENTS

| | | | |
|---|---|---|---|
| 3,366,297 | 1/1968 | Barsell | 280/11.37 A |
| 3,670,535 | 6/1972 | Stettner et al. | 280/11.37 A |
| 3,905,610 | 9/1975 | Dini | 24/73 SG |
| 3,951,421 | 4/1976 | Brangenberg | 280/11.37 E |
| 3,951,425 | 4/1976 | Lohr | 280/11.37 E |

FOREIGN PATENT DOCUMENTS

| | | | |
|---|---|---|---|
| 2,313,244 | 9/1974 | Germany | 280/11.37 A |
| 78,934 | 4/1948 | Norway | 24/73 SG |

*Primary Examiner*—Paul R. Gilliam
*Assistant Examiner*—Kenneth J. Dorner
*Attorney, Agent, or Firm*—Karl F. Ross

[57] ABSTRACT

A ski clip has a pair of identical halves, mounted on the upper surfaces of a pair of skis, each comprising a casing formed from a base and a holder defining a transverse guide channel. A resilient strap received in that channel has a thickened end clamped between the casing parts and terminates at its opposite end in a tab emerging from the casing through a slot set back from the ski edge whereby the tab and a ring hinged to it normally overlie the base within the confines of the ski. On the side remote from this slot each holder is integrally provided with a hook engageable by the ring of the other clip half when the two skis are assembled back-to-back. The casing may have an anti-crossover attachment hinged to its base of rigid with its holder.

12 Claims, 8 Drawing Figures

Fig.2
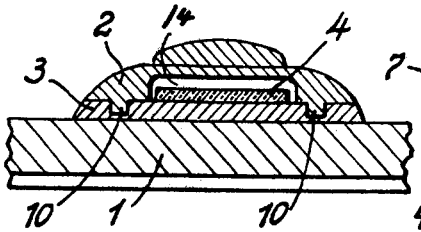
Fig.1
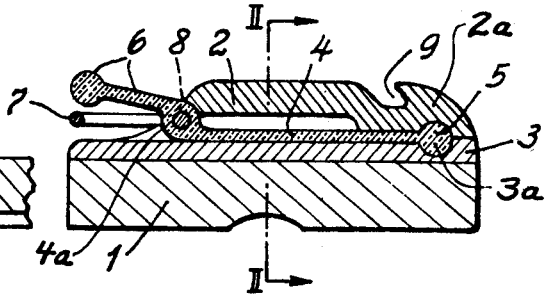
Fig.3
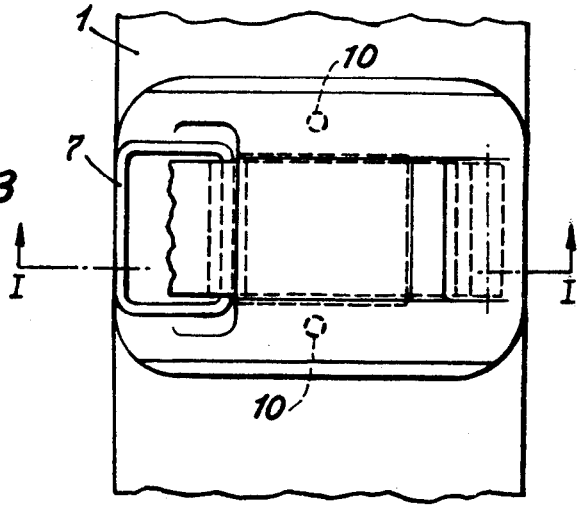
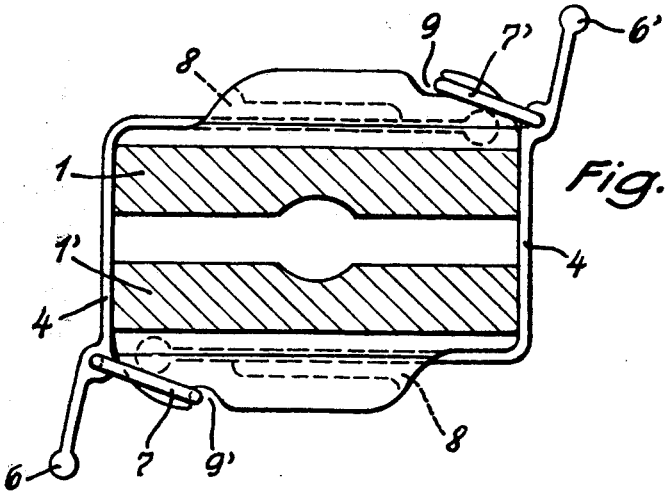
Fig.4'

DEVICE FOR BUNDLING SKIS TOGETHER IN PAIRS

This invention relates to a device, termed a ski clip, for bundling skis together in pairs by means of elastically flexible straps provided at one end with an integral extension forming a grip and carrying a hinged eye or ring. The device in accordance with my present; invention differs from conventional straps of this type in that each strap is fastened at one end to a holder arranged on a respective ski, and is so dimensioned that its free opposite end carrying the edge does not project laterally beyond the ski but allows the strap to be pulled out of the holder at right angles to the longitudinal axis of the ski against spring action, the opposite end to the grip having a catch or hook engageable with the eye or ring. The device according to the invention has the advantage that the straps for fastening the skis together are always attached to the skis, so that they cannot get lost and are ready for use at all times. Because the straps do not project beyond the sides of the skis they cannot get damaged or constitute an impediment to skiing. The above and other features of my invention will now be described in detail with reference to the accompanying drawing wherein:-

FIG. 1 is a cross-sectional view of an upper half of my improved ski clip shown fixed on a ski, taken along the line I-I of FIG. 3;

FIG. 2 is a longitudinal taller sectional view along the line II-II of FIG. 1;

FIG. 3 is a top view of the upper attachment half shown in FIGS. 1 and 2;

FIG. 4 shows a cross section of two skis bundled together by the attachment;

Figure 5:
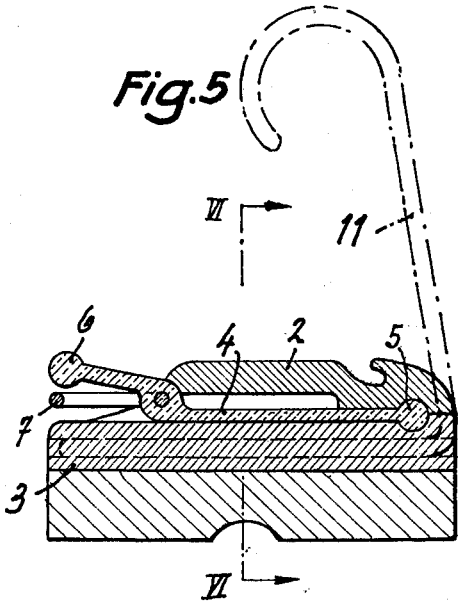
FIGS. 5 and 7 are cross-sectional views similar to FIG. 1, showing the upper halves of two further embodiments of my invention.
Figure 6:
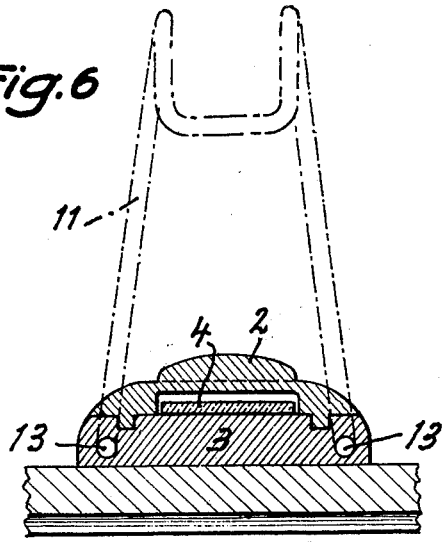
Figure 7:
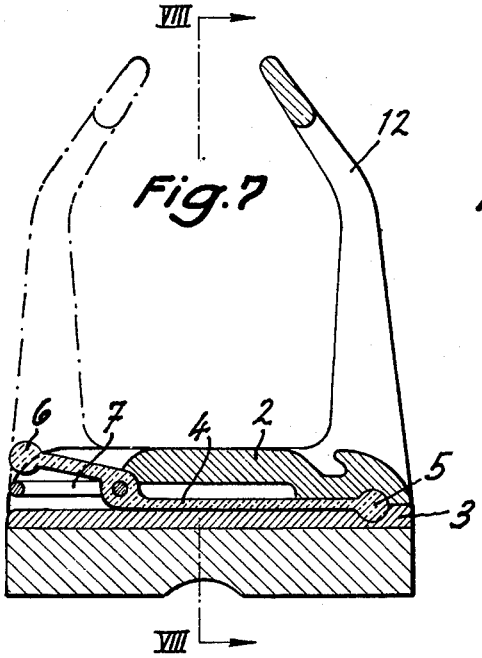
Figure 8:
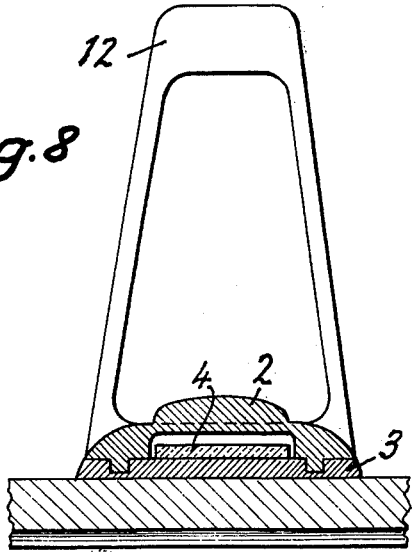

FIG. 6 is a longitudinal sectional view taken along the line VI-VI of FIG. 5; and FIG. 8 is a longitudinal sectional view taken along the line VIII-VIII of FIG. 7. In FIGS. 1 to 3 I have shown part of a ski 1 to which a holder 2 with a base 3 is secured, these two parts forming a flat casing of streamlined shape. An elastic strap 4, which may be of rubber, has a thickened end 5 which is received in confronting recesses 2*a* and 2*b* of members 2 and 3 so as to be firmly fastened in the casing. At the other end the strap terminates in a grip or tab 6 overhanging a ring 7 hinged to it. Holder 2 forms a transverse guide channel 14 for strap 4 ending in a slot 8 which is set back from the edge of base 3, and therefore from the ski edge, far enough to let grip 6 and ring 7 normally overlie the base 3 without projecting laterally beyond the ski. On its side opposite the slot 8 the casing has a hood-shaped catch 9. When the strap 4 has been inserted into the casing, the two casing parts 2 and 3 are joined together, either permanently or separably to allow the strap 4 to be changed if necessary. If the two parts of the casing are glued together, locator pins 10 mating with holes in base 3 ensure their correct relative positioning. The complete ski clip consists of two identical assemblies 2, 3, 4, 7 attached to respective skis 1, 1′ as shown in FIG. 4. Normally two such ski clips are fastened to the upper ski surfaces one of them at a distance from the tips of the skis, the other at a distance from the rear ends thereof, in such a way that all four straps 4 can be pulled out of the casings on the same side, as seen from above. The casings are alligned so as to register in pairs when the running surfaces of the skis are placed together.

With skis not in use or being carried or transported, they are usually placed with their running surfaces together, so that the catches 9 of each pair of casings are diagonally opposite each other. Strap 4 of the top ski 1 is then seized by the grip 6, drawn out of the casing, and pulled around the left-hand edges of the two skis 1 and 1′ as seen in FIG. 4, whereupon its ring 7 is hooked onto catch 9′ of the lower casing. The strap 4′ of the lower casing is then seized by the grip 6′, drawn out of its casing, and pulled around the right-hand edges of the skis 1 and 1′, whereupon its ring 7′ is hooked onto catch 9 of the upper casing. To separate the skis again the rings have only to be detached from their catches, whereupon the straps withdraw automatically into their respective casings. This withdrawal is limited by thickened junctions 4*a* between the tabs 6 and the remainder of the straps, the rings 7 being hinged to these junctions. In the embodiments shown in FIGS. 5 through 8, the same reference numerals 2 – 7 have been used as in FIGS. 1 – 4 to designate corresponding parts. Here the casings are provided with upstanding attachments which are laterally fixed thereto in order to prevent the skis from getting crossed during skiing. In the embodiment shown in FIGS. 5 and 6, the attachments 11 are stirrup-like pieces of spring wire which can be inserted into holes 13 specially provided therefor in the sides of the bases 3 of the casings.

In the embodiment shown in FIGS. 7 and 8 the attachments 12 are integral extensions of the upper casing parts 2. The casing shown in FIG. 7 with the attachment indicated in solid lines,, i.e., on the hood side, is intended for mounting on the left ski. The casing for mounting on the right ski has the attachment arranged on the side of grip 6, as indicated in phantom lines in FIG. 7. Alternatively, the embodiment shown in FIGS. 7 and 8 may also be realized with attachments disposed on both sides of the casings. The upper ends of the two attachments may then be joined together for greater strength. It is also conceivable that, instead of elastic straps, flexible but non-elastic straps might be used, that can be drawn out from reels turning against spring action. The casings may be conveniently manufactured from plastics, though of course any other suitable material might also be used. They may be joined to the skis permanently or removably, by gluing and/or screwing or any other fastening method. With plastic skis the casings or the lower parts of the casings 3 may be integral with the ski, i.e. in one piece. Where the casings are mounted separately it would also be possible to arrange resilient underlays between the casings and the skis, in order to absorb any shocks acting on the casings.

If an elastic strap is used with the device, its edges can be given a convex curvature, preferably when not under tension, so that the strap has its greatest width half-way along its length. When elastic straps are elongated they become constricted of course, this being most marked at the middle of their length. To ensure that the strap has a uniform width under tension in the stretched state, it is of advantage to have its edges curving outwards when tensionless, with the convex shape described. Alternatively it is possible to use straps that are elastic only in the section between ring 7 and the thickened end 5, while the grip 6 may be of non-elastic material. Furthermore straps can be employed which are flexible but non-elastic, being attached to springs that are tensioned when the straps are pulled out, so that the straps tend to retract back into the holders.

To facilitate changing the straps I prefer to have the two casing parts 2 and 3 screwed together or joined, say, by a fastening similar to a press stud. In the illustrated embodiments the catch 9 is made in one piece with the holder or upper casing part 2. Naturally it is also possible to have the catch fixed directly on the ski separately from the holder.

In contrast to the example shown it would also be possible to have only one ski of a pair fitted with these devices, i.e. with half the side clip shown in FIG. 4, though the straps would then have to be long enough to pass around both skis so that the ring 7 could be hooked onto the catch 9 of its own holder.

What I claim is:

1. A device for tying together a pair of skis assembled back-to-back, comprising:

at least one flat casing including a base mounted on an upper ski surface and a holder secured to said base, said casing forming a transverse channel terminating in a slot set back from an edge of said base;

a strap held under elastic tension in said channel and terminating in a tab emerging from said slot; and a ring carried by said tab, said tab and ring normally overlying a portion of said base without projecting beyond said edge, said casing being provided on its side opposite said slot with a hook engageable by the ring of an identical device.

2. A device as defined in claim 1 wherein said strap consists of resilient material and has an end remote from said tab clamped within said casing between said base and said holder.

3. A device as defined in claim 2 wherein said remote end is thickened and received in confronting recesses of said base and said holder.

4. A device as defined in claim 1 wherein said hook is integral with said holder.

5. A device for tying together a pair of skis assembled back-to-back comprising:

a pair of identical, flat casings each including a base mounted on the top surface of a respective ski and a holder secured to said base, said casing forming a transverse channel terminating in a slot set back from an edge of said base;

a strap in each casing held under elastic tension in said channel and terminating in a tab emerging from said slot; and a ring carried by the tab of each strap, said tab and said ring normally overlying a portion of said base without projecting beyond said edge thereof, each casing being provided on its side opposite said slot with a hook engageable by the ring on the strap emerging from the other casing upon a partial withdrawal of the strap by said tab against said elastic tension.

6. A device as defined in claim 5 wherein each strap consists of resilient material and has an end remote from its tab clamped within the respective casing between said base and said holder thereof.

7. A device as defined in claim 6 wherein said remote end is thickened and received in confronting recesses of the base and the holder of the respective casing.

8. A device as defined in claim 5 wherein said hook is integral with the holder of the respective casing.

9. A device as defined in claim 5 wherein each casing is provided with an upstanding anti-crossover attachment.

10. A device as defined in claim 9 wherein said attachment is hinged to the base of the respective casing.

11. A device as defined in claim 9 wherein said attachment is rigid with the holder of the respective casing.

12. A device as defined in claim 5 wherein said tab forms a thickened junction with the remainder of the strap preventing a withdrawal of the tab into said channel, said ring being hinged to the strap at said junction.

* * * * *